US005908005A

United States Patent [19]

Everett

[11] Patent Number: 5,908,005

[45] **Date of Patent: *Jun. 1, 1999**

[54] YACHT

[76] Inventor: Peter Kenneth Everett, 21 Smith Street, Chatswood, N.S.W., Australia, 2067

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,167

[22] PCT Filed: Mar. 17, 1995

[86] PCT No.: PCT/AU95/00143

§ 371 Date: Dec. 16, 1996

§ 102(e) Date: Dec. 16, 1996

[87] PCT Pub. No.: WO95/25663

PCT Pub. Date: Sep. 28, 1995

[30] Foreign Application Priority Data

Mar. 18, 1994 [AU] Australia ..... PM4539

[51] Int. Cl.[6] ..... B63B 15/00

[52] U.S. Cl. ..... 114/91

[58] Field of Search ..... 114/39.1, 89–91, 114/93, 102, 103, 138, 140, 143; 440/14, 15

[56] References Cited

U.S. PATENT DOCUMENTS

| | | | |
|---|---|---|---|
| 3,361,106 | 1/1968 | Hildebrand | 440/15 |
| 3,885,512 | 5/1975 | Marcil . | |
| 3,903,827 | 9/1975 | Marcil . | |
| 3,972,300 | 8/1976 | Adamski | 114/91 |
| 4,610,212 | 9/1986 | Petrovich | 114/91 |
| 5,072,682 | 12/1991 | Rodriguez Urroz et al. | 114/91 |
| 5,280,760 | 1/1994 | Edwards | 114/91 |

FOREIGN PATENT DOCUMENTS

| | | | |
|---|---|---|---|
| 375637 | 6/1990 | European Pat. Off. . | |
| 1423958 | 11/1965 | France | 114/39.1 |
| 2323574 | 4/1977 | France . | |
| 2689482 | 10/1993 | France | 114/103 |
| 256486 | 5/1988 | German Dem. Rep. . | |
| 3830820 | 3/1990 | Germany . | |
| 674730 | 7/1990 | Switzerland | 114/103 |
| 1184914 | 3/1970 | United Kingdom | 114/102 |

*Primary Examiner*—Ed L. Swinehart
*Attorney, Agent, or Firm*—Fulwider Patton Lee & Utecht, LLP

[57] ABSTRACT

A yacht (10) includes a mast (12) that is mechanically connected to a keel (14) via a bearing (16), located in the base of hull (18) of the yacht (10). A sail foil (30) is pivotally mounted to the top of the mast (12) via a rotating bearing (34). In use, as the wind forces the sail foil (30) and mast (12) to leeward, a corresponding movement to windward is induced in the keel (14) and thus the yacht's hull (18) can remain substantially horizontal with respect to surrounding flat water.

15 Claims, 1 Drawing Sheet

YACHT

FIELD OF THE INVENTION

The present invention relates to a yacht having a particular configuration for its mast and keel. The invention will be described with reference to its use on monohull yachts, but it should be appreciated that the invention has much broader application, for example, on other types of sail craft and vessels, and may even find application on sail craft such as wind surfers etc.

BACKGROUND OF THE INVENTION

Conventional monohull yachts use a fixed keel and a separate mast and sail plan supported by a number of stays. As the mast is basically fixed in a generally vertical orientation, when a conventional yacht is sailed into the wind, the boat tends to tilt (or heel) to angles of around 15° from the horizontal (ie. due to the action of the wind on the sails of the yacht).

It is known that yachts sail fastest when the hull is maintained approximately in a horizontal orientation, and various attempts have been made in the art to reduce the tilting (or "heeling") of yachts. For example, sail shapes have been changed to quickly release wind from the sail to minimise heeling. Current yacht designs attempt to change the shape of the main sail by displacing the mast towards the bottom of the boat whilst at the same time bending upwardly the bow and stern of the yacht. Considerable force is required to effect such alteration and a large amount of stress is induced in the sail craft to achieve such configurations.

DISCLOSURE OF THE INVENTION

The present invention provides a yacht including a mast and keel that are mechanically connected in such a manner that movement of the mast in one direction causes a movement of the keel in an opposite direction, wherein the connection is:

(i) arranged within a water-seal compartment that is separated from the remainder of the yacht and that is not dependent upon a rotating seal; and (ii) arranged below the centre of buoyancy of the yacht.

The provision of a sealing arrangement that enables the keel and mast to interact in this manner results in a leak-resistant, relatively economical yacht that can maintain its hull in a substantially horizontal orientation, especially when sailing into the wind; (ie. the deck of the yacht is essentially parallel with the surrounding flat water). Thus more efficient use of wind power is made and the yacht moves more quickly through the water because the hull is maintained in a substantially horizontal orientation.

When the term "yacht" is used herein it is intended to include all types of sail craft and may even extend to include wind surfers.

Preferably the water-seal compartment has an open upper end that in use is positioned above the surrounding water level.

Preferably the mast and keel are directly mechanically connected in a region adjacent to the base of the hull of the yacht for pivoting movement in a port-starboard aligned centre board casing water-seal compartment, the compartment allowing port and starboard pivotal movement of the mast with respect to the yacht. With a direct mechanical connection between the mast and keel a movement in one direction of the mast results in a corresponding and opposite movement in the keel.

Preferably the mast has a sail means arranged thereon so that in use, as the sail means and mast are displaced by the wind to leeward a corresponding movement is caused in the keel to windward.

Preferably the mast and keel are connected through one or more bearings arranged at the base of the hull. The or each bearing can be supported in a centre board frame, that also houses the water-seal compartment, the frame being generally arranged in a port-starboard configuration to facilitate pivoting movement of the mast between various port and starboard orientations.

Preferably the yacht includes a single bearing arranged below the centre of buoyancy of the yacht and connecting the mast and keel together, with a sealing means that connects and opens onto the compartment being provided at that part of the hull base wherein the mast and keel are connected to assist in preventing ingress of water into the compartment.

The sealing means can be a flexible sealing ring adapted for surrounding the bearing at the hull base.

The water-seal compartment can be defined by a flexible pipe means arranged for surrounding the mast and extending from the hull base at one end and having an opposite open end (preferably positioned in use to be above the water level surrounding the yacht).

In use, the yacht can be configured such that the mast moves in a tracking channel formed in the deck of the yacht.

The sail means can be a flexible or rigid sail. Preferably the sail means is mounted to the mast at a region that is approximately half way along its in-use vertical length and approximately one third of the in-use horizontal distance from its leading edge. Such positioning corresponds to the centre of effort resulting in little torsional strain on the mast.

Preferably the sail means is a rigid sail pivotally mounted to the top of the mast wherein yacht tacking involves pivoting the sail over the mast by rotating the in-use uppermost end of the sail around the top of the mast so that it becomes the in-use lowermost end of the sail. Such an arrangement considerably simplifies tacking and also enhances the tendency of the yacht to resist heeling.

The mast and/or keel may be rotatable about their respective longitudinal axes. The mast can be connected to the keel through a universal-type joint that also functions as a bearing and enables only the mast to rotate about its longitudinal axis whilst still facilitating said interaction between the mast and keel. Thus, the orientation of the sail means can be altered by rotating the mast itself (ie. in addition to any positional changes brought about by pivoting of the mast).

The keel can be a wing-type keel and the yacht hull may be a monohull-type.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

MODES FOR CARRYING OUT THE INVENTION

Figure 1:
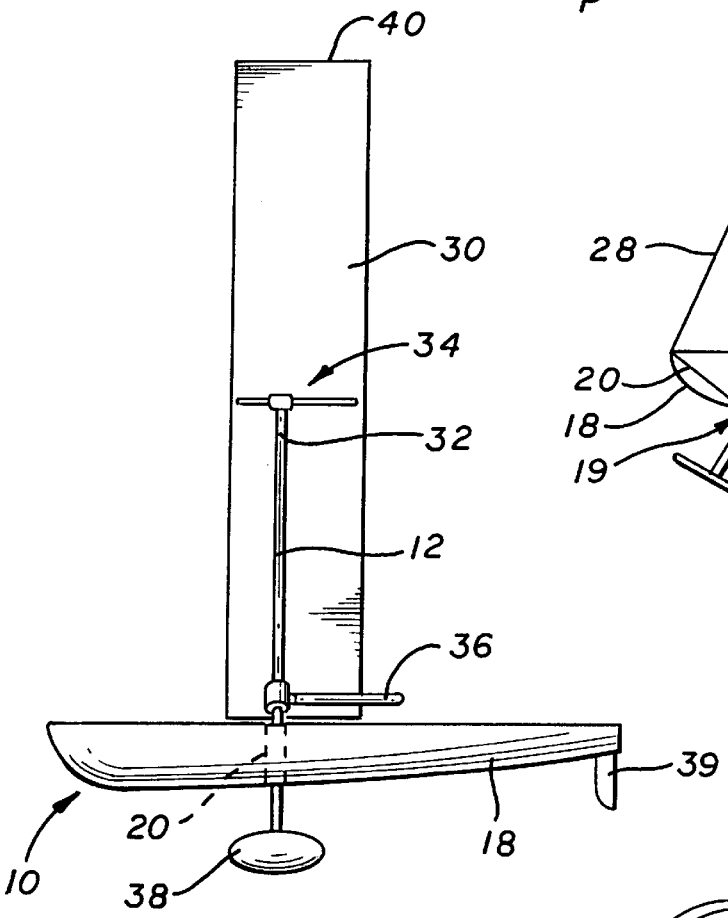
FIG. 1 shows a side elevation of a preferred yacht according to the present invention.

Referring to the drawings, a yacht in the form of monohull yacht 10 is shown. The yacht includes a mast 12 directly connected to a keel 14 via a bearing 16 arranged in the base of the yacht. The bearing is supported in the base of hull 18 in a centre board frame 20. The centre board frame reinforces and strengthens the hull to enable displacement of the mast and keel (as described below).

The area surrounding the bearing is sealed to prevent ingress of water into hull 18 by a sealing means in the form of ring seal 19. Alternatively or in addition to ring seal 19, a flexible pipe (not shown) extending from the internal base of the hull, upwardly and surrounding the mast 12 can be provided. Typically the opposite free end of this pipe would be, in use of the yacht, above the surrounding water level so that, in effect, the surrounding atmospheric air pressure would prevent the ingress of water into hull 18.

Figure 2:
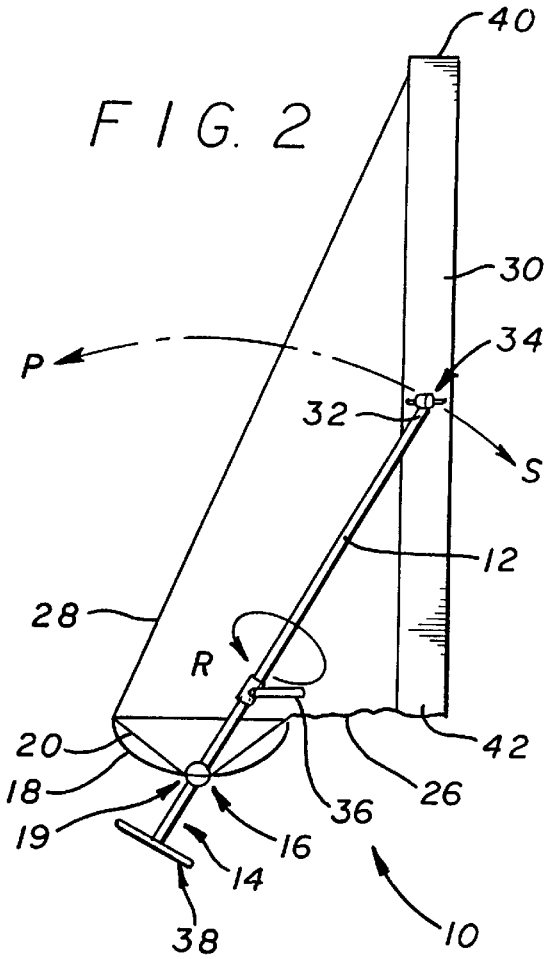
FIG. 2 shows an end elevation of the yacht of FIG. 1.

A deck 22 of the yacht is formed with a port-starboard tracking channel 24 to enable unhindered traverse of the mast 12 between port and starboard positionings on the yacht (ie. as indicated by the arrows P-S in FIG. 2). A starboard rope 26 and a port rope 28 are attached to respective ends of a sail foil 30, itself pivotally mounted to mast end 32 via rotational bearing 34. The sail foil facilitates movement of the mast (and corresponding movement of the keel) as described below.

Figure 3:
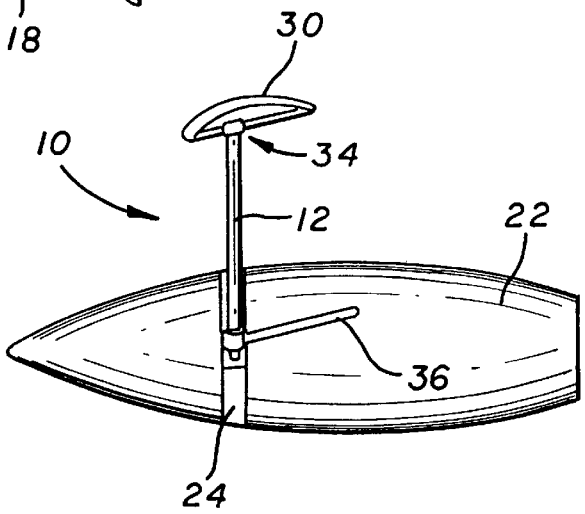
FIG. 3 shows a plan elevation of the yacht of FIG. 1.

The sail foil can be a rigid aerodynamic foil (as best indicated in FIG. 3) or can be formed from a conventional flexible sail material (and optionally braced eg. by battens etc).

The mast itself may also be rotated about its longitudinal axis (ie. as indicated by arrow R in FIG. 2). This rotation can be assisted or facilitated by a boom control arm 36 and a universal-type joint at bearing 16. Also, keel 14 can be provided with a wing-type arrangement 38 (shown in the Figures as a planar disc-like formation extending perpendicularly outwards from the keel upright).

In use of the monohull yacht, the mast and keel configurations swing from side to side usually urged by the sail foil 30. The sail foil can be positioned on either side of the yacht through rotational movement of the sail foil around rotational bearing 34 and about mast end 32. For example, the yacht shown in FIGS. 1 to 3 is in a port-tack configuration. If it is desired to bring the yacht into a starboard-tack configuration, then, as is conventional, rudder 38 is turned. However, the sail foil is brought to the portside of the boat by tensioning and pulling port rope 28 to cause sail foil ends 40 and 42 to respectively pivot around the mast end, so that end 42 finishes generally above mast end 32 and end 40 finishes generally below mast end 32. Simultaneously, the mast 12 is caused by wind action on the sail foil to pivot to the portside of the boat (ie. in the direction of arrow P in FIG. 2), whilst the keel is moved from the port underside to the starboard underside of the yacht. In this new starboard configuration, the starboard rope becomes relatively taut and the port rope relatively slack so that further tacking can be undertaken; (usually some slight tension would be maintained in the relatively slack rope to prevent outswinging of the lowermost end of sail foil 30 (eg. in sudden wind gusts).

Typically, the centre board frame is set at a position equivalent to the centre of effort of the sail plan (and is most preferably set in the port-starboard configuration rather than the conventional fore-aft configuration).

It is preferred that a thick foil sail is used with the preferred yacht configuration (although a thin sail such as a conventional sail can be used less advantageously). The preferred sail foil is preferably fixed to the top of the mast at the mid-vertical point of the sail (see drawings). Also, the fixing point is typically approximately one-third of the way back from the leading edge of the sail foil, which in practice normally corresponds to the centre of effort thereby resulting in very little torsional strain on the mast.

As indicated above, when tacking, the sail is allowed to rotate around a rotational bearing at the top of the mast so that the top of the sail foil on the previous tack becomes the bottom of the sail on the following tack.

As the top of the sail foil is held by a respective rope that is fastened to the side of the hull from where the wind is coming, in the event of a wind gust the mast can rotate further away from the wind, thereby causing the sail to be set at an angle inclined to the wind and allowing the wind to pass underneath the sail rather than over the top (as in a conventional yacht). This is roughly equivalent to a form of instantaneous reefing, (which would otherwise necessitate complex rope adjustments and the employment of more complex sail adjusting and trimming apparatus). As indicated above the mast can also be rotated (eg. by adjusting control arm 36) to change the angle of the sail relative to the mast (for performance and wind adjustment alterations etc).

As indicated above, the configuration employed has a tendency to resist yacht heeling. Thus, the bottom of the hull can be fabricated to be considerably flatter than conventional hulls (which are designed to operate typically at around 15° angle when travelling into the wind). A flat bottomed hull tends to plane more easily and thus reduces frictional resistance between the yacht and the water.

As an alternative to the monohull yacht shown in the drawings, a narrow "catamaran" hull shape can be used (ie. because the phenomenon of a changing centre of buoyancy position is not a component of the righting moment in the present yacht as it is in a conventional yacht).

As indicated above, the sail foil may be made of any suitable material, either from a flexible cloth or constructed as a solid wing. Where a flexible sail is employed, it may be formed as a hollow structure and then inflated with air to provide additional strength and shape. Air pressure could be supplied to different parts of the sail to change the sail shape (or even to reef the sail).

Also, many different types of keel configurations can be employed provided that the interaction between the mast and keel is maintained. Whilst a direct form of mechanical connection has been described between the mast and keel, indirect mechanical connection may also be employed. For example, a rope/wire and pulley arrangement which communicates between the mast and keel so that for a mast movement (eg. induced by a tack of the sail between port and starboard), a corresponding and opposite pivotal movement is produced in the keel. Hydraulic or electric control may alternatively be employed to bias or urge the keel to a new position for a corresponding movement in the mast.

Whilst the invention has been described with reference to a number of preferred embodiments, it should be appreciated that the invention can be embodied in many other forms.

I claim:

1. A yacht including a mast and keel that are mechanically connected such that when the mast is caused to move in one direction, the keel moves freely in an opposite direction, wherein the connection:

(i) is arranged within a water-seal compartment that is separated from the remainder of the yacht and that employs a sealing configuration; and (ii) is arranged below the center of buoyancy of the yacht;

the yacht further including:

a sail means that is mounted to the mast at a region that is intermediate upper and lower ends of the sail means and pivotally supported at the upper end of the mast about a fixed axis; and a pair of lines extending respectively between the yacht and the upper and lower ends of the sail means;

wherein the mounting of the sail means to the mast is such that the lines can position the sail means.

2. A yacht as claimed in claim 1 wherein the sail means is mounted to the top of the mast at a region that is approximately halfway-along the in-use vertical length of the sail means.

3. A yacht as claimed in claim 2 wherein the sail means is mounted to the mast at a region that is approximately one-third of the in-use horizontal distance from the leading edge of the sail means.

4. A yacht as claimed in claim 2 wherein the sail means has approximately the same sail area above and below the point of its mounting to the mast.

5. A yacht as claimed in claim 1 wherein the sail means is pivotally mounted to the top of the mast, wherein yacht tacking involves pivoting the sail over the mast by rotating the in-use uppermost end of the sail around the top of the mast so that it becomes the in-use lowermost end of the sail.

6. A yacht as claimed in claim 5 wherein the sail means is in the shape of a wing-foil.

7. A yacht as claimed in claim 1 wherein the sail means is mounted on the mast such that as the sail means and mast are displaced by the wind to leeward a corresponding movement is caused in the keel to windward.

8. A yacht as claimed in claim 1 wherein the mast is rotatable about its longitudinal axis.

9. A yacht as claimed in claim 1 wherein the water-seal compartment has an open upper end that in use is positioned above the surrounding water level.

10. A yacht as claimed in claim 1 wherein the mast and keel are directly mechanically connected in a region adjacent to a base of a hull of the yacht for pivoting movement in the water-seal compartment, and wherein the water-seal compartment is port-starboard aligned in the hull to allow port and starboard pivotal movement of the mast with respect to the yacht.

11. A yacht as claimed in claim 1 wherein the mast and keel are connected at at least one bearing arranged at the base of the hull.

12. A yacht as claimed in claim 11 wherein said at least one bearing is supported in a center board frame that is also the water-seal compartment, the center board frame being generally arranged in a port-starboard configuration.

13. A yacht as claimed in claim 11 wherein a single bearing is arranged below the center of buoyancy of the yacht, the bearing supporting the connection of the mast and keel.

14. A yacht as claimed in claim 10 wherein in use the mast moves in a tracking channel formed in a deck of the yacht.

15. A yacht as claimed in claim 1 wherein the keel includes a longitudinal member extending downwardly from the mechanical connection to the mast, with a wing arrangement extending outwardly from the longitudinal member.

* * * * *